United States Patent [19]

Shisler

[11] 4,368,445

[45] Jan. 11, 1983

[54] TELEVISION DEFLECTION YOKE

[75] Inventor: Robert W. Shisler, East Petersburg, Pa.

[73] Assignee: RCA Corporation, New York, N.Y.

[21] Appl. No.: 223,496

[22] Filed: Jan. 8, 1981

[51] Int. Cl.[3] ..... H01F 5/02

[52] U.S. Cl. ..... 335/210; 335/213

[58] Field of Search ..... 335/210-214; 358/248

[56] References Cited

U.S. PATENT DOCUMENTS

| | | | |
|---|---|---|---|
| 3,321,724 | 5/1967 | Obert | 335/213 |
| 3,652,966 | 3/1972 | Mei er | 335/210 |
| 4,096,531 | 6/1978 | Yamada et al. | 358/248 |
| 4,206,481 | 6/1980 | Imahashi et al. | 358/248 |

*Primary Examiner*—Harold Broome

*Attorney, Agent, or Firm*—E. M. Whitacre; P. J. Rasmussen; S. J. Stevens

[57] ABSTRACT

A deflection yoke comprises a magnetically permeable core having two separable halves. A yoke interlock member is attached to each core half with its position accurately fixed with respect to the core a pair of vertical deflection coils are toroidally-wound about the core with their position fixed with respect to the interlock members. The interlock member incorporates a number of horizontal coil engaging surface to fix the position of a horizontal coil with respect to the interlock member. The interlock member also incorporates tabs which separate the horizontal coils by a known distance. A pair of saddle-type horizontal deflection coils are disposed within the interior region of the core engaging the coil engaging surfaces and separated by the coil separation tabs. The interlock member therefore allows the construction of a yoke which provides accurate positioning of the vertical and horizontal coils with respect to each other and with respect to the core.

5 Claims, 7 Drawing Figures

TELEVISION DEFLECTION YOKE

This invention relates to a television yoke having accurately aligned and indexed horizontal and vertical deflection coils.

Television kinescope displays produce images on a lighted raster area on the face of a kinescope or picture tube. The raster is generated by scanning one or more electron beams horizontally over the faceplate of the kinescope at a relatively high speed and simultaneously providing a relatively low-speed vertical scanning. The electron beams are deflected by the magnetic fields associated with a deflection yoke which includes conductors for each of the horizontal and vertical deflection coils and which customarily includes a magnetically permeable core which provides a low-reluctance return path for the magnetic flux. The electron beam of the kinescope is deflected in the region in which the neck joins the flared portion of the kinescope, and to accommodate the shape of the kinescope, the yoke and its associated core are in the general shape of a torus or annulus having an inner surface flared from a small diameter at the electron-beam entrance end to a large diameter at the beam-exit end, corresponding to the general shape of the tube in that region.

Many current commercial television receivers use a saddle-type horizontal deflection winding in order to obtain the lowest possible inductance and resulting low power dissipation losses and toroidally-wound vertical deflection windings to reduce powerr consumption in the copper coils.

Such saddle-toroid (ST) yokes, when used with a kinescope having horizontally-aligned electron beams, may be made self-converging; that is, the design and configuration of the windings provides coils which produce magnetic deflection fields having particular non-uniform field components which can substantially converge the electron beams at all points on the raster without the need for dynamic convergence circuitry.

Much attention has, therefore, been paid to the configuration of the vertical and horizontal deflection windings. It is generally known that the portions of the conductors of the deflection windings lying along the inside of the core must be carefully distributed in order to provide a television image in which the distortion is at commercially acceptable levels.

A continuing problem in the manufacture of television displays is the sensitivity of the various distortions to minor production variations in the deflection yoke and kinescope. As a result, it is customary during manufacture to provide alignment between the vertical and horizontal coils, so-called core adjustment, along with various other adjustments, such as image centering and convergence. These alignments are most commonly performed by an operator who views the image of a test pattern and performs various positioning adjustments of the deflection yoke relative to a test kinescope. It is very desirable to reduce the number of alignments required in order to reduce yoke assembly costs and increase the efficiency of yoke production.

A major source of variability of the yoke is the form of the magnetic core. The ferrite core is manufactured by molding a putty-like green or raw ferrite material into the desired shape and firing it at high temperatures to form a ceramic-like material. In the firing process, the ferrite shrinks and slumps, assuming a shape which may be different than its prefired form. The core may be made to conform to a standard shape by grinding, but such operations are slow and expensive and are desirably avoided.

In the case of saddle-toroid yokes, the magnetic core must be split into two bilateral portions to allow the core to be positioned around the saddle horizontal windings. Since the core is split into two parts, each half of the toroidal vertical deflection winding may be wound on a half of the split core by a high speed winding machine. However, the core halves on which the windings are formed have no fixed reference points by which symmetrical windings may be generated.

As illustrated in FIG. 1, an irregular core formed from two halves 10 and 11 may have corresponding toroidal windings 12 and 13 which are centered at separate points 14 and 15, respectively. Such a deflection winding cannot provide proper convergence even when aligned with a test kinescope.

In FIG. 2, windings 22 and 23 are formed on core halves 20 and 21, respectively, with the axis of the windings centered at a point 24, which does not correspond to the physical center of the core 26. The asymmetry of the core and windings has been exaggerated to make the distortion of the windings evident. The lack of a reference point on the core creates piece-to-piece variability in the resulting yokes and results in variability in the convergence performance over the raster even when aligned with the test kinescope.

The present invention comprises a device to mechanically align the horizontal coils to the vertical coils of a deflection yoke for a cathode ray tube. Present art of alignment locates the core and coil assembly by attaching it to the front of the insulator. This will lock in the vertical and horizontal axes of the two pairs of coils, but only in the front. It does not lock in the Z (longitudinal) axis or control movement at the rear of the yoke.

In accordance with the present invention, a deflection yoke for use in a television receiver is provided which comprises a magnetically permeable core having two separable core halves. A pair of vertical deflection coils are toroidally-wound on the core halves. A pair of saddle-type horizontal deflection coils are disposed within the region bounded by the core.

A pair of yoke interlock members, mounted to the core, each comprise a plurality of core engaging surfaces to accurately fix the position of the interlock member with respect to the core. A plurality of horizontal coil engaging surfaces are provided to accurately fix the position of the horizontal coils with respect to the interlock members. A plurality of horizontal coil separation tabs, disposed between the coils of the coil pair, are also provided to accurately fix the position of one of the horizontal coils with respect to the other horizontal coil of the horizontal coil pair. In the accompanying drawing, FIGS. 1 and 2 are front elevational views of asymmetrical toroidally-wound vertical deflection coils;

Figure 1:
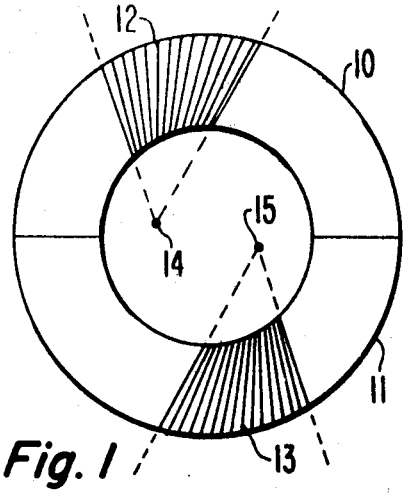
Figure 2:
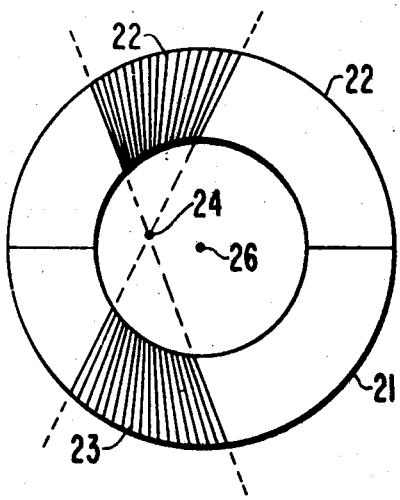
Figure 3:
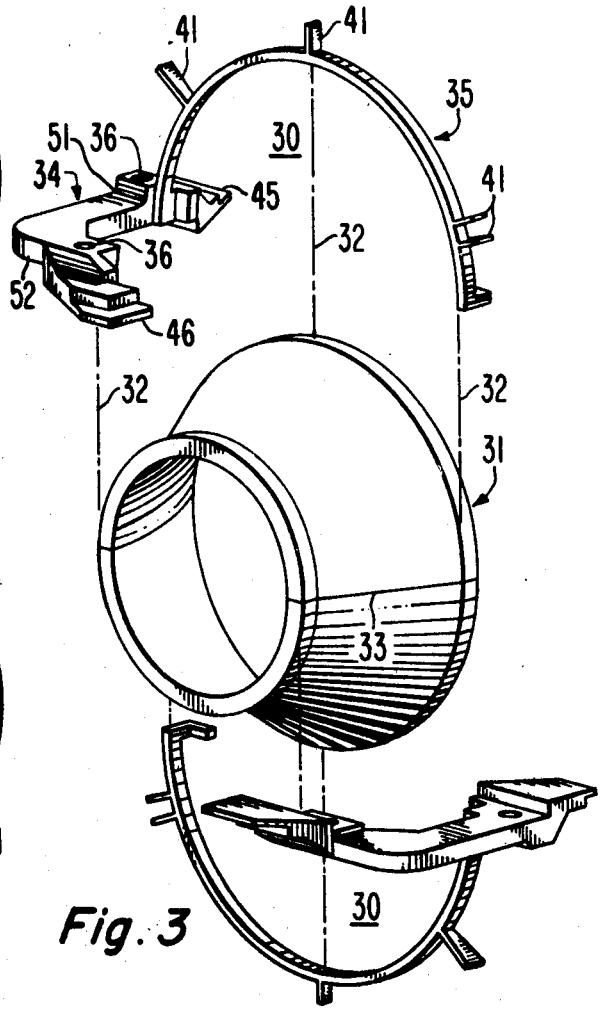
FIG. 3 is a perspective view of coil winding members in accordance with the present invention illustrating their positional relationship to the deflection yoke core.
Figure 6:
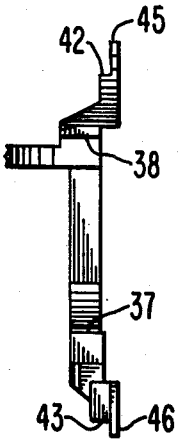
Figure 7:
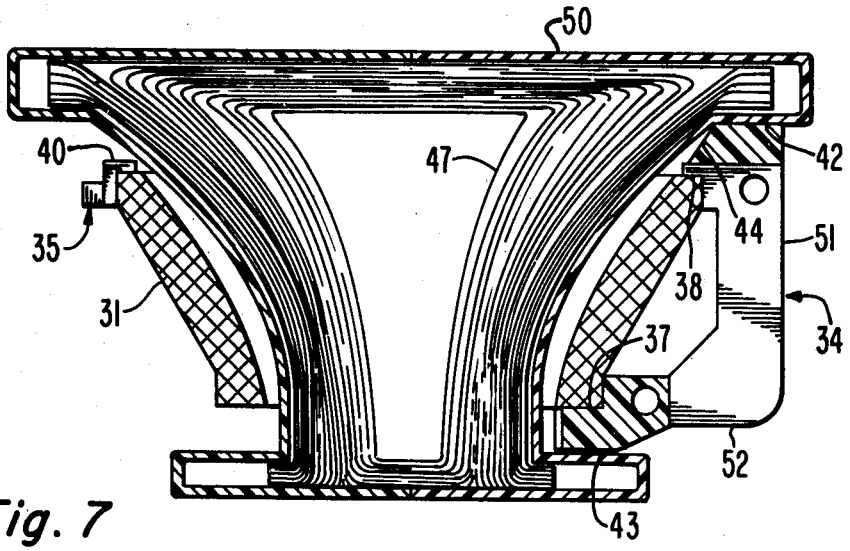

FIG. 6 is an elevational view of the end of a coil winding member of FIG. 3, partially broken away; and FIG. 7 is a cross-sectional view of a deflection yoke wound in accordance with the present invention. Referring to FIG. 3, there is shown a pair of coil interlock members 30 adjacent to a magnetically permeable deflection yoke core 31. Coil interlock members 30 are mounted in an identical manner to each of their respective core halves. Dashed lines 32 indicate the location of coil interlock members 30 when they are mounted to core 31. The relationship of coil winding interlock 30 to the core separation cracks 33 can also be seen.

Figure 5:
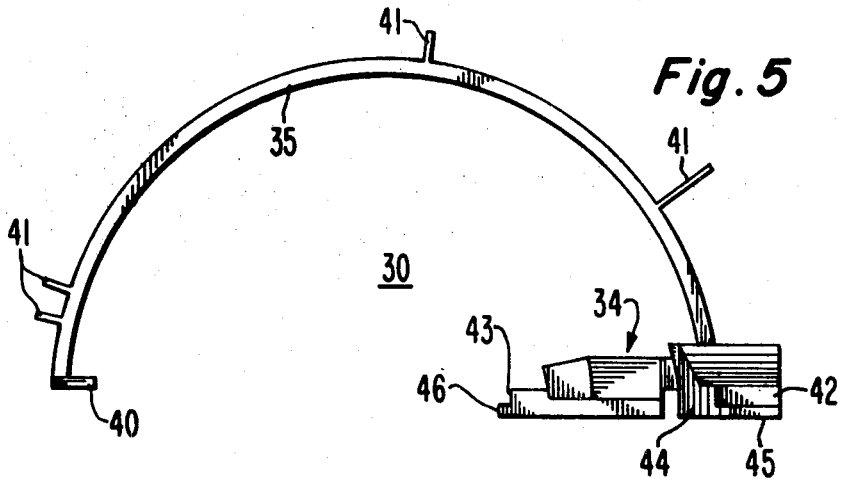
FIG. 5 is a top plan view of a coil winding member of FIG. 3.
Figure 4:
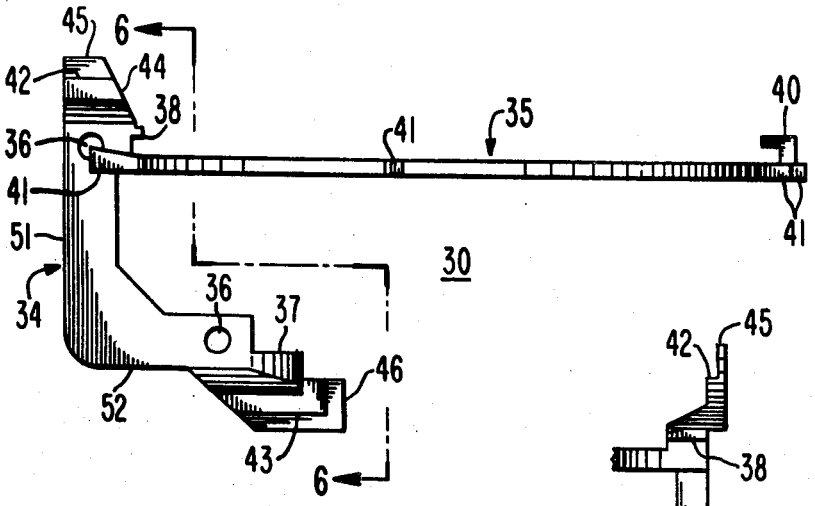
FIG. 4 is a side elevational view of one of the coil winding members shown in FIG. 3.

Coil interlock member 30 illustratively comprises an alignment member 34 and an arm member 35. By reference to FIGS. 4, 5 and 6, the structure of coil interlock member 30 will be described. Alignment member 34 is generally L-shaped having two legs 51 and 52 disposed 90° from each other. A hole 36 is located along each leg and extends through member 30. Holes 36 provide a means for attachment to a toroidal coil winding machine (not shown) for winding the vertical deflection coils. The use of holes as a means of position location and attachment to the winding machine is one alternative, and is shown as an example. Arm member 35 extends in a curved arc substantially perpendicularly from leg 51 of alignment member 34 and in a direction substantially parallel to leg 52 of alignment member 34.

A portion of leg 51 of alignment member 34 forms a ridge 38 along the inner surface of member 34. A notch 37 is formed in leg 52 of member 34. A tab 40 is disposed at the remote end of arm member 35. Ridge 38, notch 37 and tab 40 form core engaging surfaces which support one half of deflection yoke core 31 in a known, reproducible configuration. In a practical embodiment two interlock members 30 are aligned with a cracked reassembled core in a mechanical fixture to guarantee symmetry between interlock members in the completed yoke. The beam-entrance end surface of the core rests within notch 37. The core is dimensioned so that the beam-exit end surface of the core contacts ridge 28 and tab 40, as seen in FIG. 7. The core may also be formed to less exacting tolerances with any dimensional variations filled with glue or other adhesive. The location of the core with respect to interlock member 30 can, therefore, be precisely controlled and is accurately reproducible during yoke production. An adhesive of some type may be used to secure core 31 to interlock member 30 to prevent undesired movement of the core with respect to interlock member 30.

Arm member 35 incorporates a number of shoot-back and wire locating tabs 41, which extend radially outward from curved arm member 35. Selected shoot-back and locating tabs 41 are used to index the toroidal coil winding machine to provide proper placement of the windings. Other tabs 41 provide pivot points for individual wire returns during winding to allow the formation of precisely designed deflection coils having particular configurations. Arm member 35 may also incorporate grooves or slots to receive individual wires or groups of wires to further provide accuracy in formation of the deflection coils. It is to be understood that the desired operation and advantages of the present invention may be realized by an interlock member which does not include an arm member 35. Arm member 35 aids in winding the vertical deflection coils, which may be wound in other ways, and, therefore, it may be unnecessary.

Alignment member 34 also comprises horizontal coil engaging surfaces 42 and 43 located near the ends of the legs 51 and 52 of alignment member 34. Coil engaging surface 42 is located in leg 51 alignment member 34. Coil engaging surface 43 comprises two surface components, disposed at right angles to each other. Coil engaging surfaces 42 and 43 are dimensioned to contact portions of the saddle-type horizontal deflection coils. Coil engaging surface 42 contacts the end turns of the deflection coil at its beam-exit end, while one component of the coil engaging surface 43 contacts the beam-entrance end turns of the coil. The other component of coil engaging surface 43 contacts the active turns of the horizontal coil near its beam-entrance end.

The remaining important structural elements of alignment member 34 are horizontal coil engaging surface 44, located adjacent to coil engaging surface 42, and horizontal coil separation tabs 45 and 46, located at the ends of legs 51 and 52 of alignment member 34. Coil engaging surface 44 contacts the flared active conductors of the saddle-type coil. Coil separation tabs 45 and 46 are dimensioned to be disposed between the two saddle coils of the horizontal deflection windings to provide a predetermined separation between the coils. A second coil interlock member is located on the opposite side of core 31 from interlock member 30 and has an identical structure and function with respect to the other core half, vertical deflection coil and horizontal saddle coil.

As previously described, ridge 38, notch 37 and tab 40 provide a predetermined positional relationship between core 31, the vertical deflection coil and interlock member 30. Coil engaging surfaces 42, 43 and 44, and coil separation tabs 45 and 46 provide a similar predetermined positional relationship between interlock member 30 and the saddle-type horizontal deflection coils. Through contact with the horizontal coil end turns, coil engaging surface 42 and part of coil engaging surface 43 prevent undesired movement of the horizontal coil in a direction along its longitudinal axis. Through contact between the coil and coil engaging surface 44 and the other part of coil engaging surface 43, transverse motion of the coil is prevented. A fixed separation between the coils is, as previously mentioned, provided by coil separation tabs 45 and 46.

The coil interlock members are therefore fixed to the core halves in accurate alignment with respect to each other via the operation of a mounting fixture. The vertical deflection coils may then be toroidally wound on each core half with their position fixed with respect to each of their respective interlock member. The horizontal coils are then assembled into the yoke with their position accurately determined by the coil engaging surfaces and separation tabs of the interlock members. The completed yoke, therefore, has an accurate, fixed relationship between the core, vertical deflection coils, and horizontal deflection coils.

The assembly of a deflection yoke without adjustment of the relationship between the vertical and horizontal coils is provided, thereby saving time and adjustment apparatus expense.

Interlock member 30 is preferably made of plastic or other insulating material. Because of the known, fixed relationship between the coils, the yoke assembled in accordance with the present invention may be manufactured without the usual plastic insulator between the vertical and horizontal coils. If an insulator is nevertheless desired, holes may be provided through the insulator to allow the passage of coil separation tabs 45 and 46.

FIG. 7 illustrates a cross-sectional view of an assembled deflection yoke utilizing the invention. A horizontal deflection coil 47 is shown positioned inside an insulator 50. Magnetically permeable core 31 is shown supported by notch 37 and ridge 38 of alignment member 34 and tab 40 of arm member 35. Insulator 50 is shown in contact with coil engaging surfaces 42, 43 and 44, and of alignment member 34. If the yoke were constructed without an insulator, the horizontal coils themselves would contact surfaces 42, 43 and 44, as previously described.

Through the use of interlock member 30, therefore, a yoke may be constructed which requires no adjustment of alignment between the horizontal and vertical deflection coils. The need for costly core and coil adjusting machinery is eliminated, thereby increasing the manufacturing efficiency and reducing the cost of the completed deflection yokes.

What is claimed is:

1. A deflection yoke for use in a television receiver, comprising:

a magnetically permeable core having two separable core halves;

a pair of horizontal deflection coils;

a pair of yoke interlock members, one of said members mounted to each of said core halves in predetermined positional relationship to the other of said members, each of said members comprising:

a plurality of core engaging surfaces to accurately fix the position of said interlock member with respect to said core half;

a plurality of horizontal deflection coil engaging surfaces to accurately fix the position of one of said horizontal deflection coils with respect to said interlock member; and a pair of vertical deflection coils, each of said vertical coils toroidally-wound on a respective core half in predetermined positional relationship relative to said interlock members, whereby each of said horizontal deflection coils is held in predetermined positional relationship with respect to the other of said horizontal deflection coils, each of said vertical deflection coils is held in predetermined positional relationship with respect to the other of said vertical deflection coils, whereby said horizontal deflection coils are held in predetermined positional relationship with respect to said vertical deflection coils.

2. The arrangement in claim 1, wherein said interlock members further comprise coil winding alignment members for aligning the position of said vertical deflection coils with respect to said interlock members.

3. The arrangement defined in claim 2, wherein said coil winding alignment members incorporate a core engaging surface to accurately fix the position of said core with respect to said interlock member.

4. The arrangement defined in claim 2, wherein said coil winding alignment members incorporate coil winding shoot-back tabs.

5. A method of forming a television deflection yoke comprising a magnetically permeable core having two separable core halves, comprising the steps of:

mounting yoke interlock members on each of said core halves via a plurality of core engaging surface of said interlock members in such manner as to provide a predetermined positional relationship between said core half and said interlock member;

winding a pair of vertical deflection coils on said core halves in predetermined positional relationship with respect to said interlock member;

mounting a pair of horizontal deflection coils to said yoke via a plurality of coil engaging surfaces of said interlock members in such manner as to provide a predetermined positional relationship between said horizontal deflection coils and said interlock members.

* * * * *